US005148694A

United States Patent [19]

Pearson et al.

[11] Patent Number: 5,148,694

[45] Date of Patent: Sep. 22, 1992

[54] SHEET METAL FORMING APPARATUS

[75] Inventors: Bruce M. Pearson, Westminster; W. Wayne Worrell, Lafayette, both of Colo.

[73] Assignee: Zimmerman Metals, Inc., Denver, Colo.

[21] Appl. No.: 692,287

[22] Filed: Apr. 26, 1991

[51] Int. Cl.[5] ..... B21D 5/08

[52] U.S. Cl. ..... 72/131; 72/181

[58] Field of Search ..... 72/181, 182, 179, 249, 72/248, 129, 131

[56] References Cited

U.S. PATENT DOCUMENTS

| | | | |
|---|---|---|---|
| 3,529,461 | 9/1970 | Knudson | 72/181 |
| 3,791,185 | 2/1974 | Knudson | 72/181 |
| 3,823,592 | 7/1974 | Colbath | 72/181 |
| 3,842,647 | 10/1974 | Knudson | 72/177 |
| 3,914,971 | 10/1975 | Colbath | 72/181 |
| 4,120,123 | 10/1978 | Knudson | 52/86 |
| 4,471,641 | 9/1984 | Mitchell | 72/181 |
| 4,621,511 | 11/1986 | Knudson | 72/186 |
| 4,660,399 | 4/1987 | Suter | 72/181 |
| 4,716,754 | 1/1988 | Youngs | 72/181 |
| 4,766,707 | 8/1988 | Knudson | 52/98 |
| 4,811,587 | 3/1989 | Knudson | 72/181 |
| 4,899,566 | 2/1990 | Knudson | 72/129 |
| 4,947,671 | 8/1990 | Lindstrom | 72/181 |
| 4,981,060 | 1/1991 | Knudson | 83/555 |

*Primary Examiner*—Daniel C. Crane

*Attorney, Agent, or Firm*—Sheridan, Ross & McIntosh

[57] ABSTRACT

An apparatus for forming sheet metal panels is provided. One embodiment generally includes a frame structure, a pair of laterally displaced longitudinal supports slidably interconnected with the frame structure, a forming assembly positioned along both of these supports, a plurality of screw rods extending between and threadably engaged with the supports, an advancing assembly positioned substantially about the central longitudinal axis of the frame, and a cutting assembly. The spacing between the supports is adjusted to accommodate for various widths of the sheet metal by rotating the screw rods which either draws the supports in or forces them out substantially the same distance. Sheet metal is then provided to the advancing assembly which engages and moves the sheet metal through the forming assembly. After the desired contour of the sheet metal is achieved by passing through the laterally displaced portions of the forming assembly, the cutting assembly cuts the sheet metal panel to the desired length.

34 Claims, 10 Drawing Sheets

SHEET METAL FORMING APPARATUS

FIELD OF THE INVENTION

This invention generally relates to the field of sheet metal forming devices and, more particularly, to a sheet metal forming device which utilizes a forming assembly having laterally displaced portions for working sheet metal into a desired configuration, an advancing assembly, positioned between such laterally displaced portions, for advancing the sheet metal through the forming assembly, and a width adjustment assembly for modifying the width between such laterally displaced portions.

BACKGROUND OF THE INVENTION

The use of sheet metal in the construction industry for roofing and/or siding material has long been known. One method of utilization comprises forming panel sections of a desired length and width from a roll of sheet metal in such a manner that a plurality of the panels may be interconnected to provide a substantially continuous roofing or siding surface.

Various types of sheet metal forming machines have been devised to address the needs of the construction industry by providing for the mass production of interconnectable sheet metal panels according to certain prescribed specifications. These machines typically have a frame structure which is sufficiently wide to allow various widths of sheet metal to be advanced therethrough. Positioned within this frame structure and attached thereto in a variety of manners are a plurality of laterally displaced roller assemblies. More particularly, a pair of substantially vertically aligned upper and lower rollers are successively positioned along two longitudinal and laterally displaced supports within the frame structure. The contours of these upper and lower rollers successively change such that the longitudinal edge portions of the sheet metal are gradually worked into the desired configuration.

A significant disadvantage associated with the known devices is that the rollers are used t onot only form the sheet metal, but are also connected to and rotated by an appropriate drive source to draw the sheet metal through the successive pairs of rollers. Since these rollers are typically metal so as to be able to adequately perform forming operations, the vertical spacing between each upper and lower roller must be sufficiently small in order for the rollers to sufficiently grip the sheet metal for advancement therethrough. More particularly, since there is metal-on-metal contact between the magnitude of frictional force required to advance the sheet metal, the vertically aligned rollers must be vertically separated less than the thickness of the sheet metal passing therethrough. Consequently, the sheet metal may, among other things, undergo an undesired deformation (i.e., a thinning of the sheet metal) in this region, subjecting the metal to increased stresses which could induce cracking and thereby affecting the panel's structural integrity and durability.

As can be appreciated, not every application will require panel sections of the same size (length and width). For instance, size requirements may vary from building to building. Moreover, panel size requirements within a single structure may in fact vary based upon the particular design being used (i.e., certain sections may need to be individually sized to accommodate for a given design). In order to address this need, existing sheet metal forming machines have also incorporated a width adjusting device for altering the width between the laterally displaced pairs of rollers. Additionally, such machines have also incorporated a cutting assembly to cut the panel sections into a desired length.

Existing width adjusting devices typically have one of the pairs of upper and lower rollers along the longitudinal supports remain laterally stationary. However, the oppositely-positioned succession of pairs of upper and lower rollers may be extended or retracted relative to the other pairs by an appropriate mechanism. As can be appreciated, if these laterally movable rollers are extended further away from their support it can become more difficult to generate the required frictional force to appropriately engage and move the sheet metal. Consequently, the sheet metal can advance at different rates through the succession of rollers on opposite edges producing an unsatisfactory end product (i.e., the sheet metal may become skewed relative to the rollers)

Thus, there is a need for a sheet metal forming device which reduces the amount of unwanted metal deformation and stresses within the sheet metal being formed. Moreover, there is a need for a sheet metal forming device which is adjustable to accommodate for the formation of various widths of sheet metal without adversely affecting forming operations.

SUMMARY OF THE INVENTION

One embodiment of the present invention allows for the production of interconnectable sheet metal panels having a desired configuration in a manner which reduces the amount of unwanted metal deformation experienced by such panels during the formation procedure. In this regard, the present invention generally includes a frame structure, a pair of laterally displaced forming devices for working the two longitudinal edge portions of the sheet metal into a desired configuration, and an advancing mechanism, positioned between the laterally displaced forming devices, to move the sheet metal through the forming devices Since the forming devices do not move the sheet metal, less force may be exerted by the forming devices on the sheet metal which reduces the amount of unwanted metal deformation in these regions Although a variety of forming devices may be used to appropriately work the sheet metal, in one embodiment these forming devices are a plurality of removably connected forming roller assemblies each of which comprises an upper and substantially vertically aligned lower forming roller. Metal forming rollers are preferred since they possess a sufficient hardness to effectively work the longitudinal edge portions of the sheet metal. Moreover, since a separate advancing mechanism is utilized, these forming rollers may be freely rotatable, thereby eliminating the need for any type of drive mechanism for rotating the rollers At least one forming roller assembly is positioned on each of two laterally displaced supports within the frame structure such that the sheet metal may pass therethrough to work the longitudinal edge portions. Preferably a plurality of forming roller assemblies having progressively changing contours are positioned along each of the two laterally displaced longitudinal supports to progressively work the longitudinal edge portions into the desired shape.

The centrally located advancing mechanism allows for a reduction in the amount of force exerted on the longitudinal edge portions of the sheet metal, which in turn reduces the amount of unwanted metal deformation in these regions In one embodiment the advancing mechanism is positioned substantially about the central longitudinal axis of the frame structure. With this orientation, the sheet metal is uniformly advanced through the forming devices such that the potential for the development of steering problems (i.e., the sheet metal becoming twisted or skewed within the frame structure) is reduced.

In one embodiment, the advancing mechanism comprises a plurality of upper drive rollers spaced longitudinally along the frame structure and a plurality of substantially vertically aligned and thus equally spaced lower drive rollers. The drive rollers are utilized such that the sheet metal will be advanced through the entire frame structure to form the panels. In another embodiment there are pairs of laterally spaced upper and lower drive rollers. Optional drive arrangements are possible, i.e., either one roller/pair of rollers may be driven while the remaining rollers are synchronously driven therefrom by interconnecting systems or each roller/pair of rollers may be separately driven.

The advancing mechanism assists in reducing unwanted metal deformation along the sheet metal edges by reducing the amount of force applied by the forming devices. In order to avoid introducing unwanted metal deformation in the sheet metal by the advancing mechanism, sheet metal engaging materials may be utilized. In one embodiment a pliable or elastomeric cover is utilized over the drive rollers to engage the sheet metal. A cover is advantageous as frictional engagement between the sheet metal and advancing mechanism is enhanced. Additionally, the cover deforms varying amounts depending on the sheet metal thickness rather than introducing any unwanted metal deformation. Consequently, when a cover is incorporated onto the outer surfaces of the upper and lower drive rollers, sufficient frictional force is applied to advance sheet metal of various thicknesses.

In one embodiment of the present invention, various widths of sheet panel sections may be formed. In this regard, the present invention generally includes a frame structure, a pair of laterally displaced supports or channels slidably interconnected with the frame structure, forming devices connected to each of these channels to work the longitudinal edge portions of the sheet metal, a screw rod extending between and threadably engaged with both channels, a mechanism for rotating the screw rod and an advancing mechanism. The ends of the screw rod are oppositely threaded such that rotation of the screw rod in one direction draws the channels inwardly along the screw rod substantially the same distance, while rotation of the screw rod in the opposite direction forces both channels outwardly along the screw rod substantially the same distance. Consequently, the width of the displaced forming devices may be adjusted to accommodate for the use of different widths of sheet metal without adversely affecting the forming operations.

As can be appreciated, when the channels supporting the forming devices are sufficiently long, it is desirable to utilize a plurality of screw rods spaced along such channels to avoid skew. In this case, the plurality of screw rods may be individually driven or only one screw rod may be driven directly while the remaining screw rods are appropriately interconnected thereto, for example, by a chain and gear assembly, thus producing synchronous rotation of all screw rods to provide the desired width adjustment feature.

The present invention may also include a number of other desirable features. For instance, the present invention may include a cutting mechanism such that sheet metal panel sections may be cut to a desired length. Moreover, the frame structure may be mounted on wheels to increase the mobility of the present invention. Furthermore, the frame structure may be constructed to provide a portable unit which may be taken to a construction site. In this regard, the present invention may include a lift mechanism which may be detachably connected to the frame structure so that the present invention may be effectively maneuvered. Moreover, the present invention may also include a detachable control unit for controlling panel forming operations, which is particularly advantageous when the present invention is used at the construction site.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
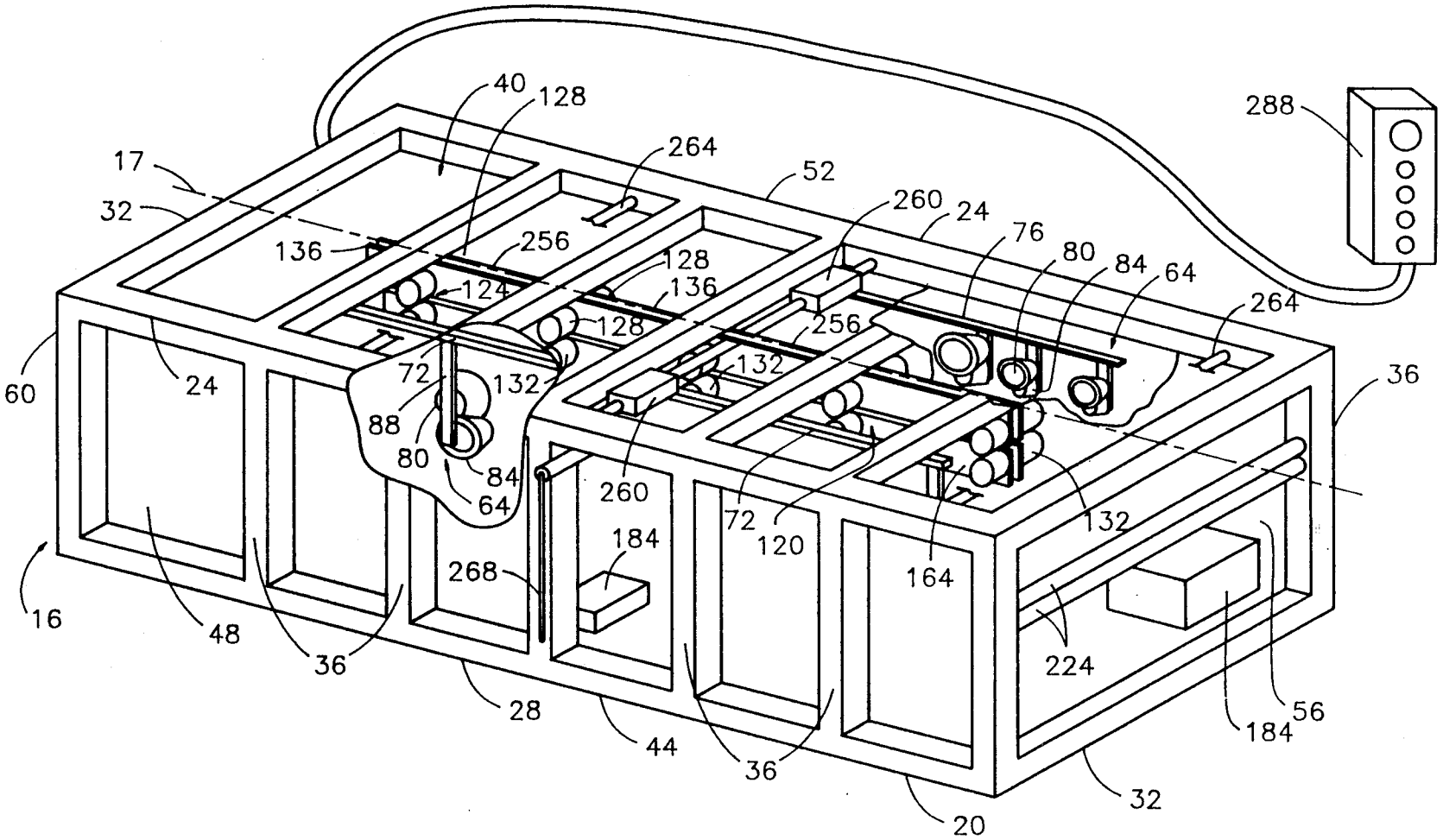
FIG. 1 is a perspective view of one embodiment of the sheet metal former of the present invention, having broken away certain portions thereof to illustrate certain interior portions.

In one embodiment of the present invention, unwanted metal deformation is reduced during formation of interconnectable panels from a roll of sheet metal such as, for example, galvanized steel. Referring to FIG. 1, a sheet metal former 16 generally includes: a frame 20 which serves as a support structure for the present invention, a forming assembly 64 which works portions of the sheet metal along its two longitudinal edges into a desired shape, and an advancing assembly 120 for moving the sheet metal through the forming assembly 64. Since the advancing assembly 120 is used to move the sheet metal through the forming assembly 64, the amount of force which the forming assembly 64 exerts on the sheet metal can be reduced. Consequently, a desirable reduction in the amount of unwanted metal deformation results in those portions of the sheet metal being worked by the forming assembly 64.

Figure 2:
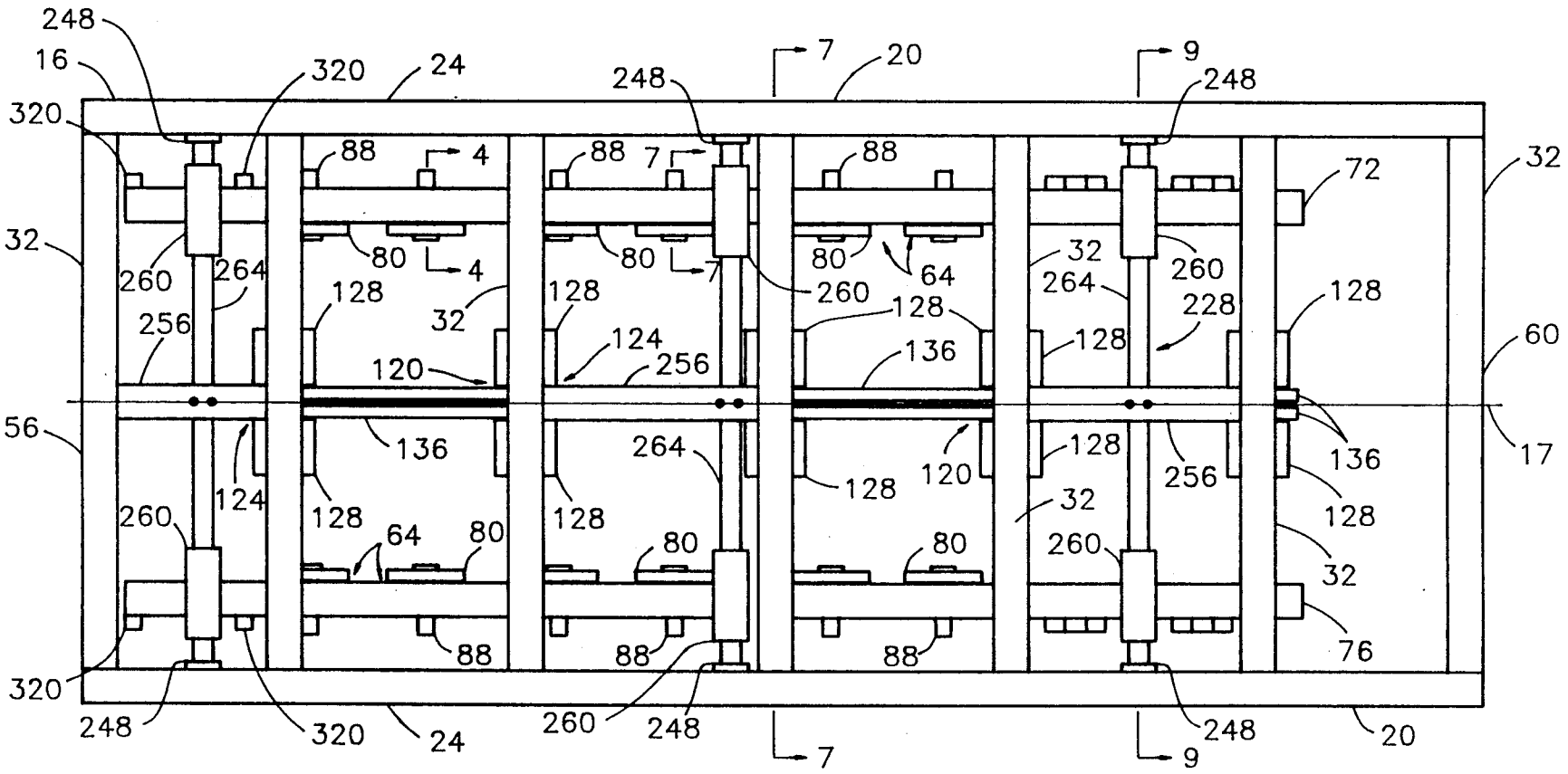
FIG. 2 is a top view of the sheet metal former of FIG. 1.
Figure 3:
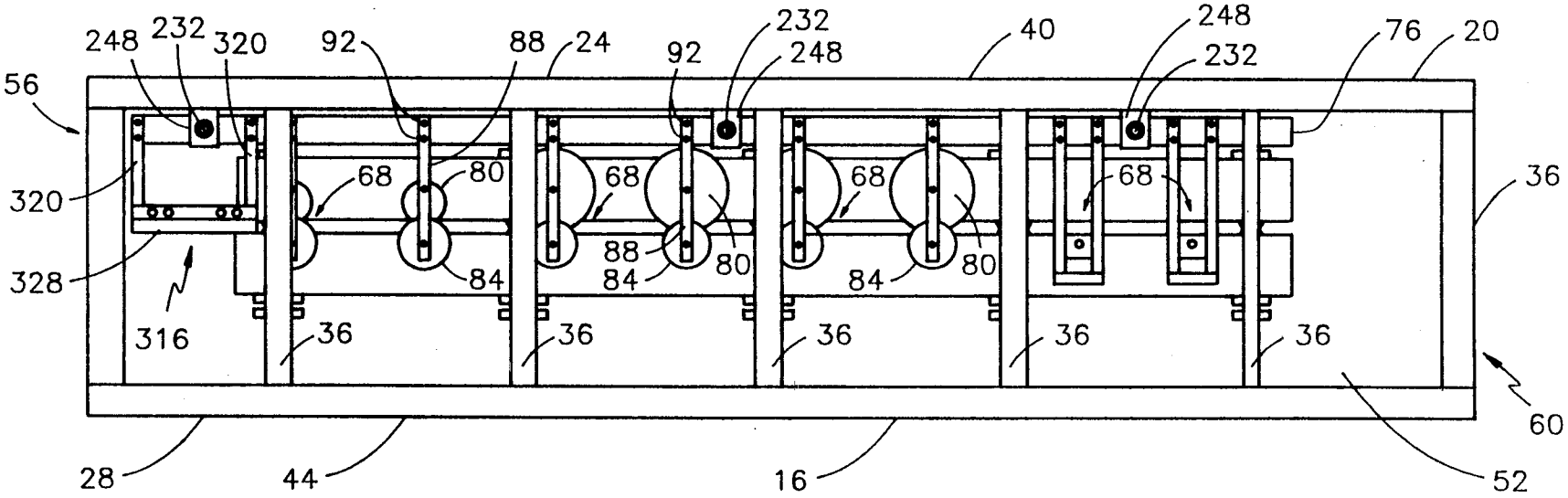
FIG. 3 is a side view of the sheet metal former of FIG. 1.

As illustrated in FIGS. 1–3, the frame 20 is formed by a pair of laterally displaced top rails 24 and a pair of laterally displaced and substantially vertically aligned bottom rails 28. A plurality of cross rails 32 extend substantially horizontally between and are appropriately attached to the two top rails 24 and also extend substantially horizontally between and are appropriately attached to the two bottom rails 28. A plurality of side rails 36 extend substantially vertically between and are appropriately connected to each pair of vertically a igned top and bottom rails 24, 28. Consequently, the frame 20 formed by this structure includes a top 40, bottom 44, first and second sides 48, 52, and entry and exit ends 56, 60. Although not shown, it is to be understood that the frame 20 may be appropriately covered for safety considerations.

Figure 5:
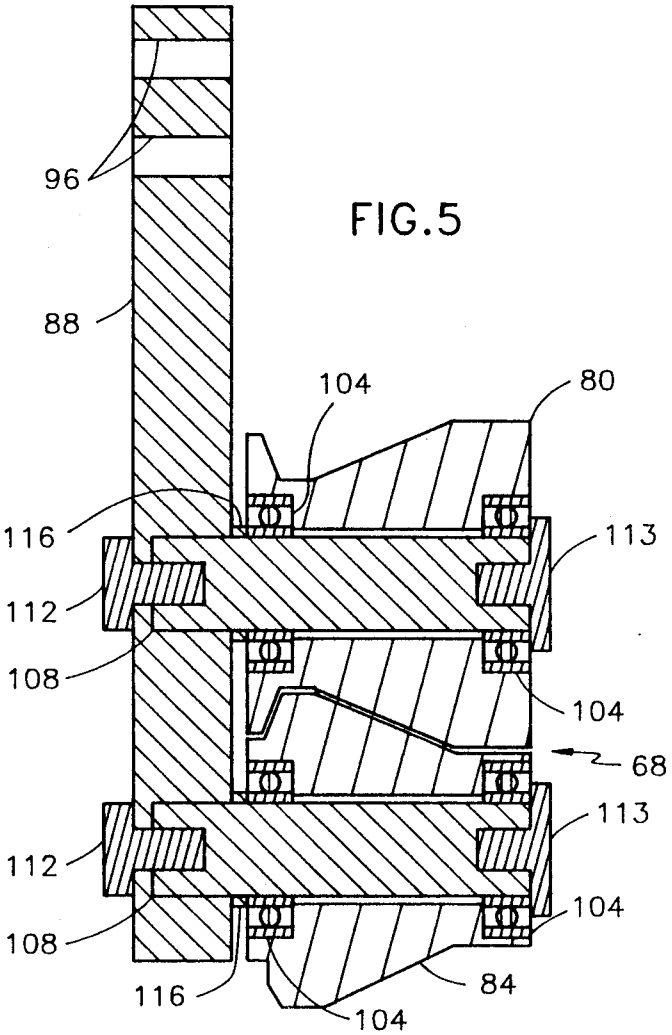
FIG. 5 is a cross-sectional view of another embodiment of a forming roller assembly taken along line 5—5 in FIG. 2.
Figure 4:
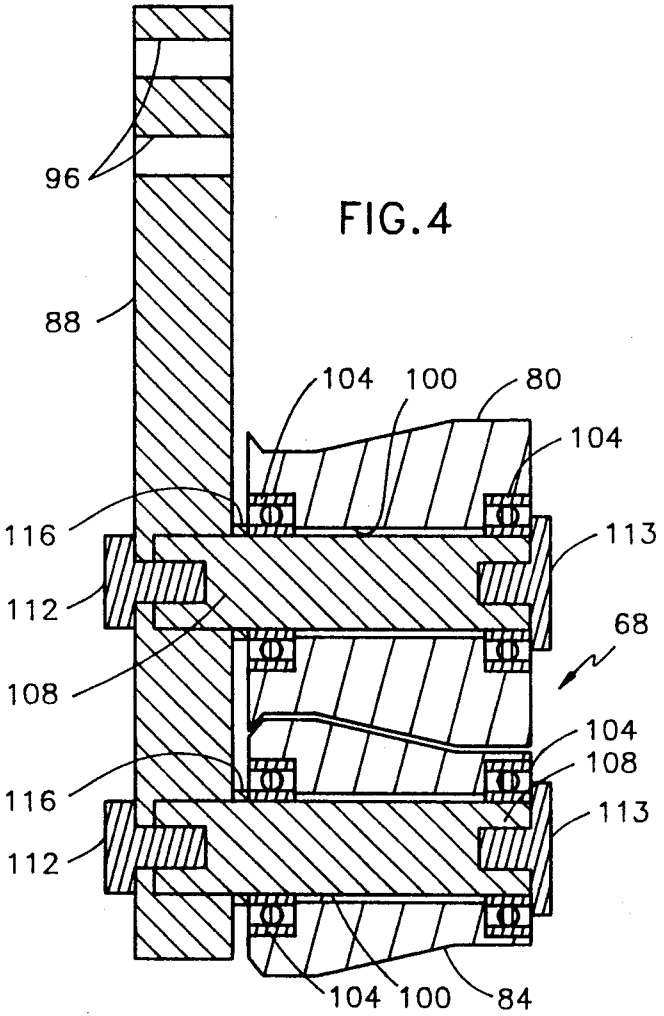
FIG. 4 is a cross-sectional view of one embodiment of a forming roller assembly taken along line 4—4 in FIG. 2.

The primary function of the forming assembly 64 is to work the two longitudinal edge portions of a width of sheet metal (not shown) into a desired shape such that the sheet metal panel sections formed thereby may be appropriately interconnected. One embodiment of the forming assembly 64 includes a plurality of rotatable forming roller assemblies 68 which are positioned and spaced along first and second sliding supports or channels 72, 76 as best illustrated in FIGS. 1–2. The first and second sliding channels 72, 76 are laterally displaced within the frame 20 such that a length of sheet metal of a given width may pass therethrough and have its two longitudinal edge portions worked by the plurality of forming roller assemblies 68, which are best illustrated in FIGS. 3–5. The first and second sliding channels 72, 76 are slidably interconnected with the frame 20 such that the distance between the laterally displaced forming roller assemblies 68 may be adjusted to accommodate for the formation of different widths of sheet metal, as will be subsequently described in greater detail.

As illustrated in FIGS. 3–5, each forming roller assembly 68 includes an upper forming roller 80 and a substantially vertically aligned lower forming roller 84, each of which are preferably formed from a metal of a suitable hardness to be able to effectively work the sheet metal into the desired shape. As best illustrated in FIGS. 4–5, the contours of the upper and lower forming rollers 80, 84 will change along the length of the channels 72, 76 so as to gradually work the longitudinal edge portions of the sheet metal into the desired contour, as is known in the art (i.e., the sheet metal would be worked by the forming roller assembly 68 of FIG. 4 before being worked by the subsequent forming roller assembly 68 of FIG. 5). Furthermore, the forming roller assemblies 68 near the exit end 60 of the frame 20 on the first and second sliding channels 72, 76 may be vertically adjustable to compensate for any undesired bending or bowing of the sheet metal panel after its formation, as is also known in the art. Although not shown, it is to be understood that the assemblies 68 may be removably attached in order to allow modification of the former 16 to produce alternatively shaped panels.

When the first and second sliding channels 72, 76 are being used as the supporting structure, each pair of upper and lower forming rollers 80, 84 are directly supported by a forming roller support 88 which extends vertically downward from and which is appropriately connectable to the first or second sliding channel 72, 76. Downward extension of the support 88 is necessary so that the components of the width adjustment of the forming assembly 64 (discussed below) will not interfere with the operations of other aspects of the present invention. For example, one suitable method for attaching the plurality of forming roller supports 88 along both the first and second s iding channels 72, 76 is to pass bolts 92 (FIG. 3) through holes 96 (FIGS. 4–5) in the forming roller supports 88 and corresponding holes (not shown) in the first and second sliding channels 72, 76 to which the individual forming roller support 88 is attached. Nuts (not shown) may of course then be placed upon the bolts 92 to secure the plurality of forming roller supports 88 to the first and second sliding channels 72, 76.

When utilizing the advancing assembly 120, the upper and lower rollers 80, 84 are freely rotatable. One alternative for establishing the rotatable connection between the upper and lower forming rollers 80, 84 and the corresponding forming roller support 88 is illustrated in FIGS. 4–5. Reference will only be made herein to the rotatable connection for a single upper forming roller 80 since all such connections will be similarly made. The upper forming roller 80 has a bore 100 therethrough which coincides with its rotational axis. Roller bearings 104 are positioned on each end of the upper forming roller 80 to support a roller shaft 108 which extends through the bore 100. The roller shaft 108 is maintained within the bore 100 by a roller fastener 112, which abuts the forming roller support 88 and engages one end of the roller shaft 108, and by a roller fastener 113, which abuts a surface of one roller bearing 104 and engages the opposite end of the roller shaft 108. A spacer 116 separates the upper forming roller 80 from the forming roller support 88. Consequently, based upon this connection, the upper forming roller 80 is able to freely rotate about the roller shaft 108.

In order to facilitate entry of the sheet metal into the forming assembly 64, a pair of vertically aligned and freely rotatable guide rollers 224 may be positioned at the entry end 56 of the frame 20 and appropriately connected thereto, as generally illustrated in FIG. 1. Moreover, an entry guide assembly 316 may be positioned on the first and second sliding channels 72, 76 near the entry end 56, as illustrated in FIG. 3. This entry guide assembly 316 may include, for instance, a pair of guide supports 320 which are attached to and extend vertically downward from both the first and second sliding channels 72, 76 (FIGS. 2–3). A number of pairs of vertically aligned and spaced guide pins (not shown) extend within the frame 20 and are attached along the guide cross supports 328 to further support the sheet metal. These guide cross supports 328 are positioned between the pairs of guide supports 320 on each of the first and second sliding channels 72, 76.

Although the forming assembly 64 has been described with reference to a plurality of freely rotatable forming roller assemblies 68, those skilled in the art will appreciate that various other types of forming devices may be utilized to achieve the effect of reducing unwanted metal deformation in the formed regions of the sheet metal since an advancing assembly 120, not the forming assembly 64, is used to transfer the sheet metal through the forming assembly 64. Consequently, the forming assembly 64 may, for instance, comprise arcuately-shaped surfaces (not shown) between which the sheet metal would pass to be progressively worked into the desired configuration.

The utilization of an advancing assembly 120 to move the sheet metal allows for a reduction in the amount of forces exerted on the sheet metal by the forming assembly 64, thereby reducing the amount of unwanted metal deformation in the sheet metal. As can be appreciated, it is preferable to position the advancing assembly 120 substantially centrally between the above described laterally displaced portions of the forming assembly 64 and substantially centrally about a longitudinal axis 17 of the frame 20 as best illustrated in FIGS. 1–2. This particular orientation of the advancing assembly 120 reduces the potential for the development of steering problems when the sheet metal passes through the forming assembly 64 (i.e., the potential for the longitudinal axis of the sheet metal becoming skewed relative to the longitudinal axis 17 of the frame 20).

Referring generally to FIGS. 1–2 and more particularly to 6–8, one embodiment of the advancing assembly 120 generally includes a plurality of drive roller assemblies 124 which are spaced along an axis of the frame 20, and are again preferably centrally positioned about the central longitudinal axis 17. The drive roller assemblies 12 include a pair of laterally displaced upper drive rollers 128 which are substantially vertically aligned with a pair of laterally displaced lower drive rollers 132 (see FIG. 1). Rotation of the upper and lower drive rollers 128, 132 in a manner described below advances the sheet metal through the forming assembly 64 by essentially drawing th sheet metal within the frame 20. As can be appreciated, other combinations of upper and lower drive rollers 128, 132 may be used, such as, for instance, only a single upper drive roller and only a vertically displaced single lower drive roller (not shown).

Figure 6:
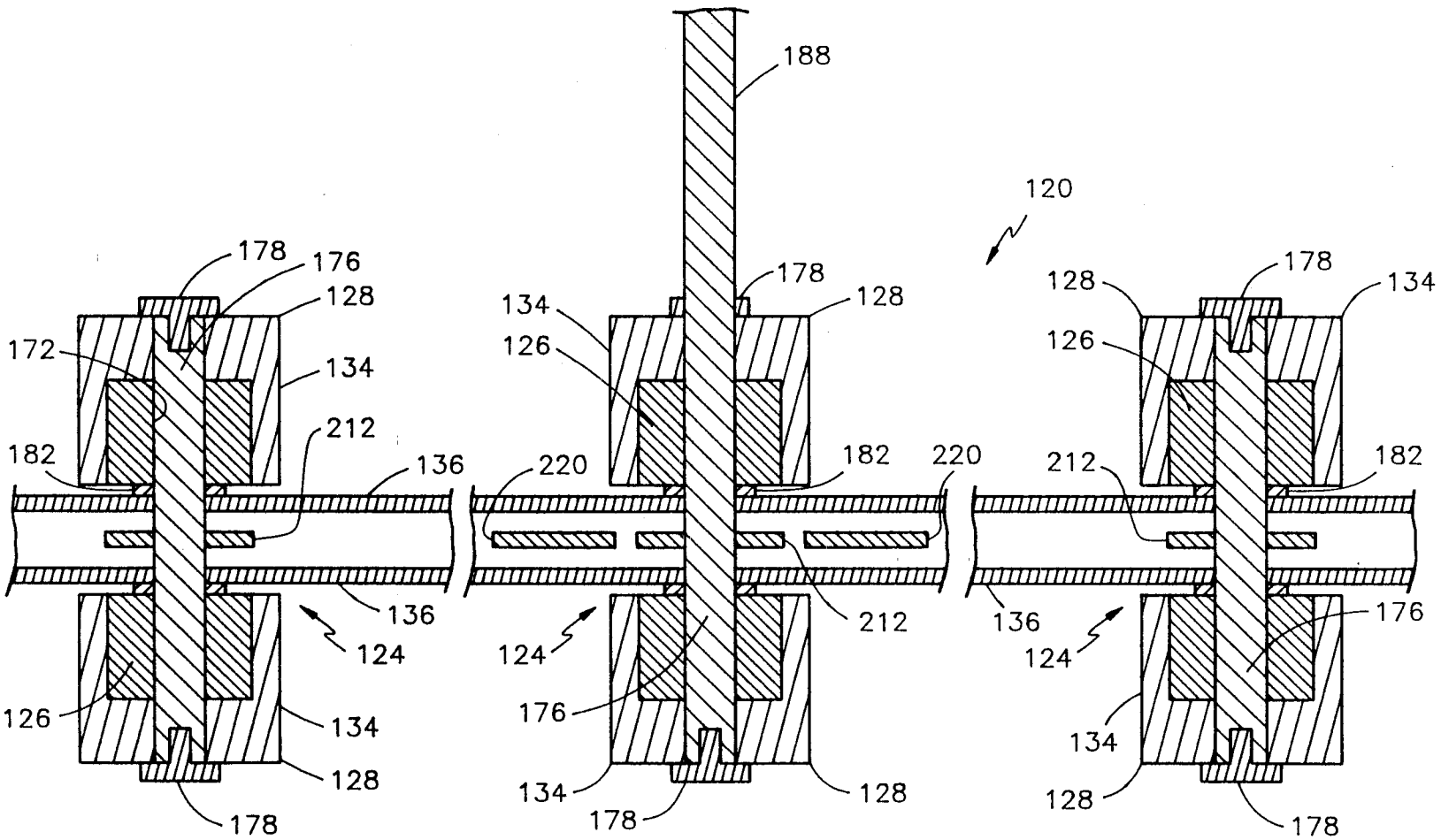
FIG. 6 is a cross-sectional view of one embodiment of the upper portion of the advancing assembly.
Figure 7:
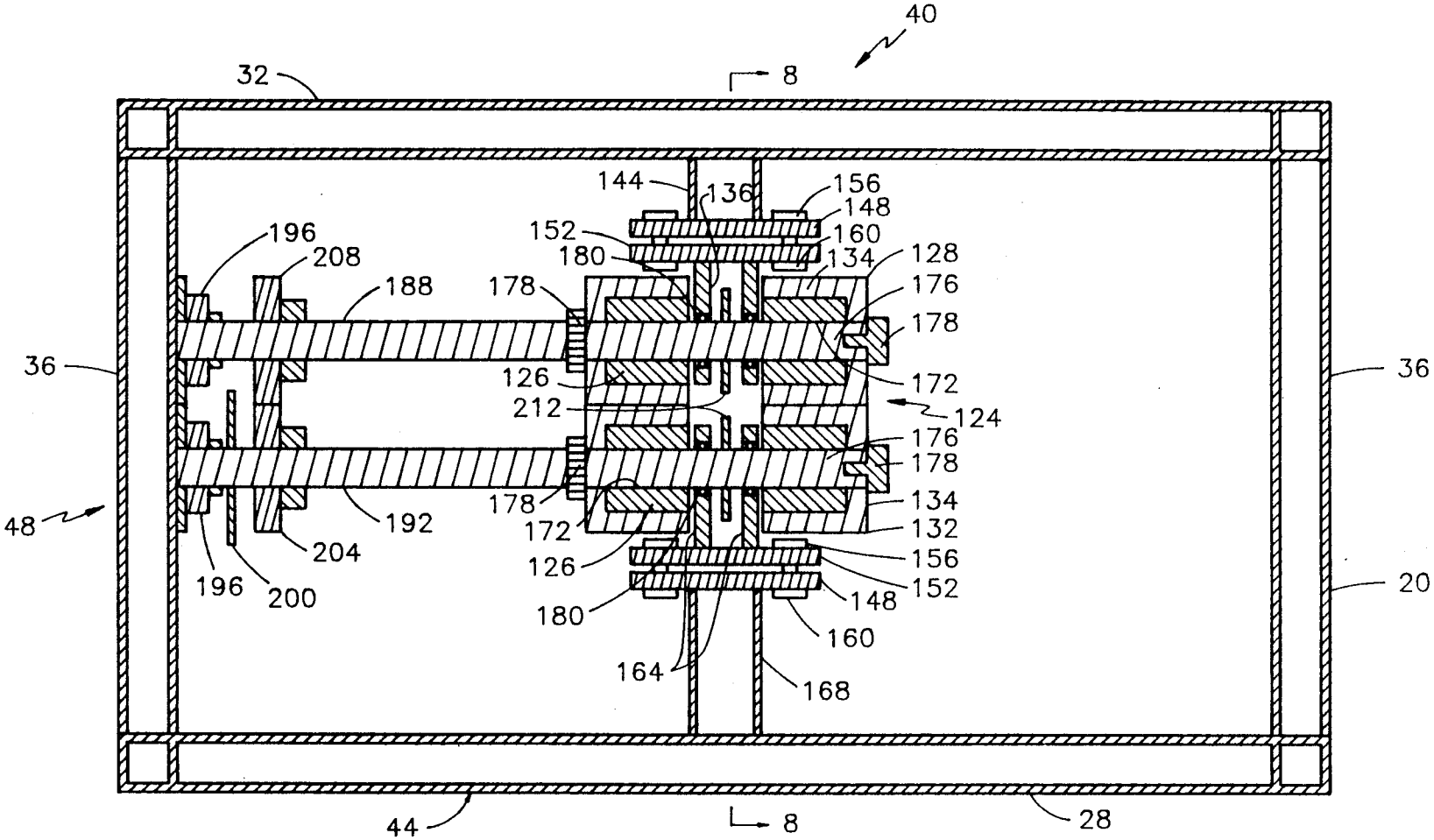
FIG. 7 is a cross-sectional view of an upper and lower drive roller assembly taken along line 7—7 in FIG. 2.

The upper and lower drive rollers 128, 132 are positioned along upper and lower drive roller supports 136, 164, respectively, which extend along the axis 17 of the frame 20 as best illustrated in FIGS. 1, 2, 6 and 7. Referring to FIG. 7, the upper drive roller support 136 is attached to the top 40 of the frame 20 by a plurality of upper channel extensions 144. More particularly, an upper channel extension 144 is attached to and extends downwardly from a sufficient number of the cross rails 32 to adequately support the upper drive roller support 136. An extension plate 148, attached to the end of these upper channel extensions 144, connects to a support plate 152 which is appropriately attached to the upper drive roller support 136. A plurality of support plates 152 are spaced along the upper drive roller support 136 in substantial vertical alignment with the extension plates 148. Consequently, the extension and support plates 148, 152 are appropriately connected, such as by utilizing bolts 156 and nuts 160. The lower drive roller support 164 is similarly connected to the bottom 44 of the frame 20 by a plurality of lower channel extensions 168 which extend upwardly from the cross rails 32 positioned on the bottom 44 of the frame 20.

The upper and lower drive rollers 128, 132 are rotatably supported by the upper and lower drive roller supports 136, 164, respectively, in a similar manner and therefore reference will only be made to a single pair of upper, laterally displaced, drive rollers 128. Referring to FIG. 6, a bore 172 extends through the upper drive roller 128 which therefore coincides with its rotational axis. Positioned within this bore 172 is a drive roller shaft 176 which extends through horizontally aligned roller bearings 180 suitably positioned in the uppe drive roller support 136 (FIG. 7). This drive roller shaft 176 then extends through the bore 172 in the laterally displaced upper drive roller 128. The shaft 176 is maintained in its position by appropriate fasteners 178. Consequently, each pair of laterally displaced upper and lower drive rollers 128, 132 will synchronously rotate when driven in the manner described below.

The upper and lower drive rollers 128, 132 are driven by single motor 184 which is only generally illustrated in FIG. 1, although it can be appreciated that each pair of upper and lower drive rollers 128, 132 may be individually driven by an appropriate source. Referring to FIGS. 6-7, an upper drive shaft 188 and a lower drive shaft 192 effectively engage a single pair of laterally displaced upper and lower drive rollers 128, 132, respectively. The upper and lower drive shafts 188, 192 are supported on one end by bearings 196 positioned on a side rail 36 of the first side 48 of the frame 20 and are supported on the opposite ends by the upper and lower drive roller supports 136, 164 through the respective upper and lower drive rollers 128, 132. A main drive sprocket 200 is fixedly attached to the lower drive shaft 192 such that a chain (not shown) ma be positioned therearound to be rotatably driven by the motor 184 which is powered by a power source 183 (see FIG. 1). Also attached to the lower drive shaft 192 is gear 204 which engages with gear 208 attached to the upper drive shaft 188. When the main drive sprocket 200 is rotated by the motor 184 via a chain (not shown), both the upper and lower drive shafts 188, 192 are synchronously rotated in the desired manner to draw the sheet metal between the upper and lower drive rollers 128, 132 through their respective rotations.

Figure 8:
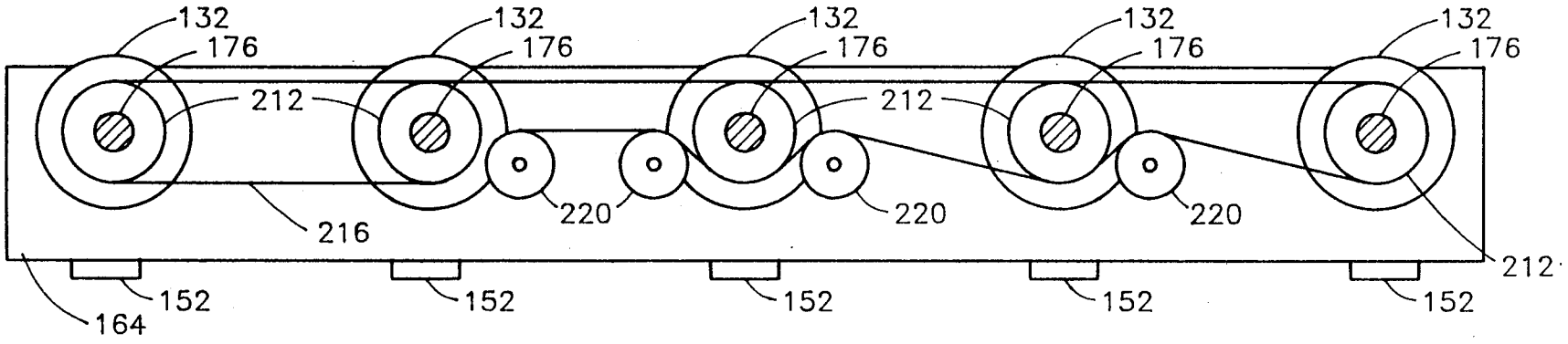
FIG. 8 is a cross-sectional view of the chain and sprocket drive system for the lower drive rollers taken along line 8—8 in FIG. 7.

The remaining upper and lower drive rollers 128, 132 are rotated in the desired manner by being interconnected to the upper and lower drive shafts 188, 192 as best illustrated in FIGS. 6 and 8. A sprocket 212 is fixedly attached to the drive roller shafts 176 between the downwardly extending portions of the respective upper and lower drive roller supports 136, 164. A chain 216 extends around these sprockets 212 such that all of the upper and lower drive rollers 128, 132 are interconnected. A plurality of guide sprockets 220 may also be required to maintain sufficient tension in the chain 216. Consequently, when the motor 184 drives the main drive sprocket 200, the upper and lower drive shafts 188, 192 are rotated in the desired manner which in turn rotates the sprockets 212 on the drive roller shafts 176 to synchronously rotate all of the upper and lower drive rollers 128, 132.

The primary advantage in utilizing the advancing assembly 120 is a reduction in the amount of unwanted deformation in the sheet metal produced by the use of a driven forming assembly 64 as in the prior art. In order to reduce the potential for the advancing assembly 120 itself inducing undesirable deformation of the sheet metal, the upper and lower drive rollers 128, 132 are preferably provided with a cover 134 of pliable or elastomeric material, such as, for example, rubber or polyurethane. The interior portion 126 of each upper and lower drive rollers 128–132 may be formed from a suitable metal. Consequently, the vertical spacing between the upper and lower drive rollers 128, 132 may be minimal to allow sufficient frictional engagement with the sheet metal for advancement through the forming assembly 64 without causing damage thereto. Moreover, although the vertical spacing is small, the cover 134 itself will deform rather than the sheet metal for a variety of thicknesses.

In operation, the sheet metal (not shown) is positioned between the first drive roller assembly 124 on the entry end 56 of the frame 20. As previously discussed, guide rollers 224 (FIG. 1) and an entry guide assembly 316 (FIGS. 2-3) may be used to further support the sheet metal within the frame 20. After the sheet metal is properly positioned, the motor 184 may be engaged to initiate the advancing assembly 120. The motor 184 drives the main drive sprocket 200 (FIG. 7) via a chain (not shown) which in turn synchronously rotates the upper and lower drive shafts 188, 192 to rotate the upper and lower drive rollers 128, 132 in the above-described manner. As the sheet metal is advanced within the frame 20 by the upper and lower drive rollers 128, 132, the forming assembly 64 gradually works the longitudinal edge portions of the sheet metal into the desired configuration.

In another embodiment of the present invention, the distance the laterally displaced portions of the forming assembly 64 may be adjusted such that different widths of sheet metal may be used. As generally discussed above, one embodiment of the forming assembly 64 is a plurality of freely rotatable forming roller assemblies 68 which are rotatably attached to the first and second sliding channels 72, 76. However, it can be appreciated that it is not necessary to utilize freely rotatable forming roller assemblies 68. Instead, the upper and lower forming rollers 80, 84 may be driven as is known in the art to advance the sheet metal. However, preferably, the width adjustment assembly 228 is used in combination with the above-described forming assembly 64 and advancing assembly 120 to provide a plurality of desirable features.

Figure 9:
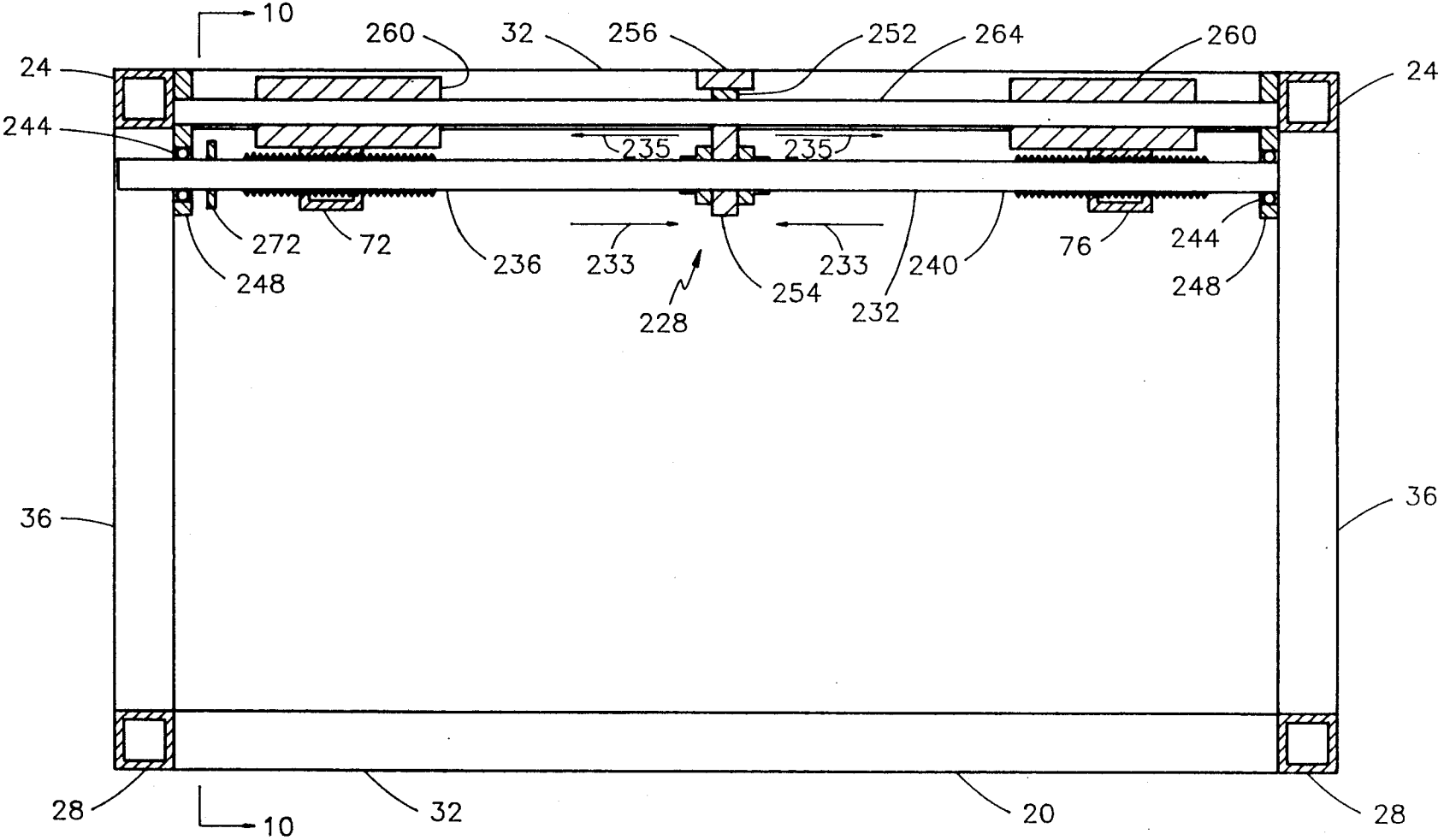
FIG. 9 is a cross-sectional view of one embodiment of the width adjustment assembly taken along line 9—9 in FIG. 2.

One embodiment of a width adjustment assembly 228 is generally illustrated in FIGS. 1-2 and more particularly in FIG. 9. A screw rod 232 having a first portion 236 and a second portion 240 is threadably engaged with the first and second sliding channels 72, 76, respectively. The ends of the first and second portions 236, 240 of the screw rod 232 are supported by a bearing 244 positioned in extensions 248 which are appropriately attached to each top rail 24. Additional support is provided in the central region of the screw rod 232 by an extension 252 which is appropriately attached to a cross rail connector 256. The cross rail connector 256 is positioned between adjacent cross rails 32 as best illustrated in FIG. 2. A support 254 is positioned on the end of the extension 252 to engage and support the screw rod 236.

In order to offer further support for the first and second sliding channels 72, 76, pillow blocks 260 may be appropriately attached to the first and second sliding channels 72, 76. The pillow blocks 260 are then slidably engaged with a slide rod 264 which extends laterally across the frame 20 in substantial vertical alignment with the screw rod 232. The slide rod 264 is also centrally supported by the extension 252. When the screw rod 232 is rotated in a first direction by turning the ratchet handl 268 (FIG. 1), the first and second sliding channels 72, 76 are drawn inwardly as indicated by arrows 233 along the screw rod 232 and the pillow blocks 260 appropriately slide on the slide rod 264. When the screw rod 232 is rotated in an opposite direction, the first and second sliding channels 72, 76 are forced outwardly as indicated by arrows 235 along the screw rod 232 and the pillow blocks 260 appropriately slide on the slide rod 264. Consequently, the laterally displaced portions of the forming assembly 64 are substantially equally adjusted without affecting the support of such laterally displaced portions.

Although only a single screw rod 232 is actually needed to adjust the width of the laterally displaced portions of the forming assembly 64, when the first and second sliding channels 72, 76 are of a certain length, equalized movement thereof may be somewhat difficult utilizing only a single screw rod 232. Consequently, a plurality of screw rods 232 are spaced along the first and second sliding channels 72, 76 as best illustrated in FIGS. 1-2. Each of these screw rods 232 may of course be individually rotated by an appropriate mechanism. However, as can be appreciated, the screw rods 232 should be rotated at the same time and in the same amount to avoid any binding or misalignment of the first and second sliding channels 72, 76. Therefore, the present invention also provides for interconnection of these scre rods 232.

Figure 10:
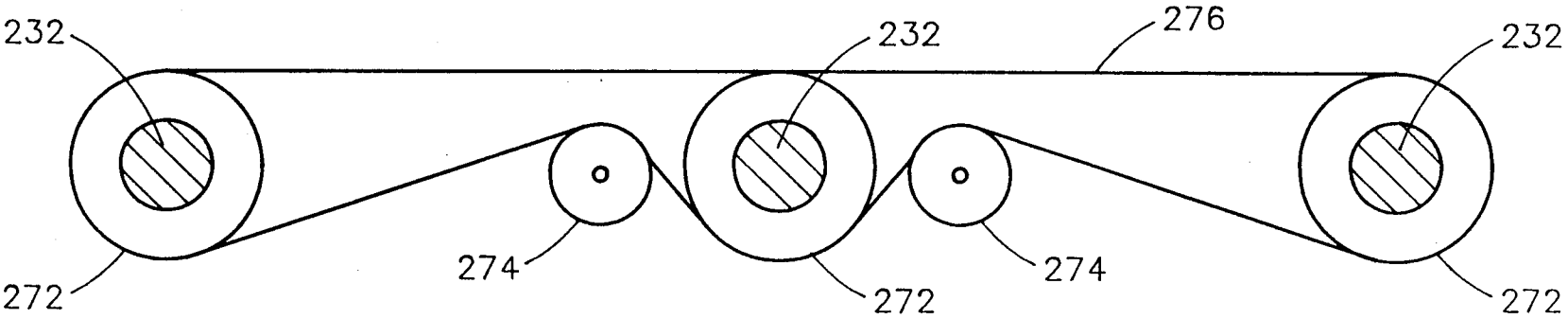
FIG. 10 is a cross-sectional view of the chain and sprocket drive system for the width adjustment assembly taken along line 10—10 in FIG. 9.

Referring to FIG. 10, sprockets 272 may be positioned near an end of the screw rods 232 such that a chain 276 may be positioned therearound. A number of sprockets 274 may also be required to maintain proper tension in the chain 276. Rotation of only one of the screw rods 232 by the handle 268 will thus produce synchronous rotation of all screw rods 232 to uniformly adjust the distance between the first and second sliding channels 72, 76.

Figure 11:
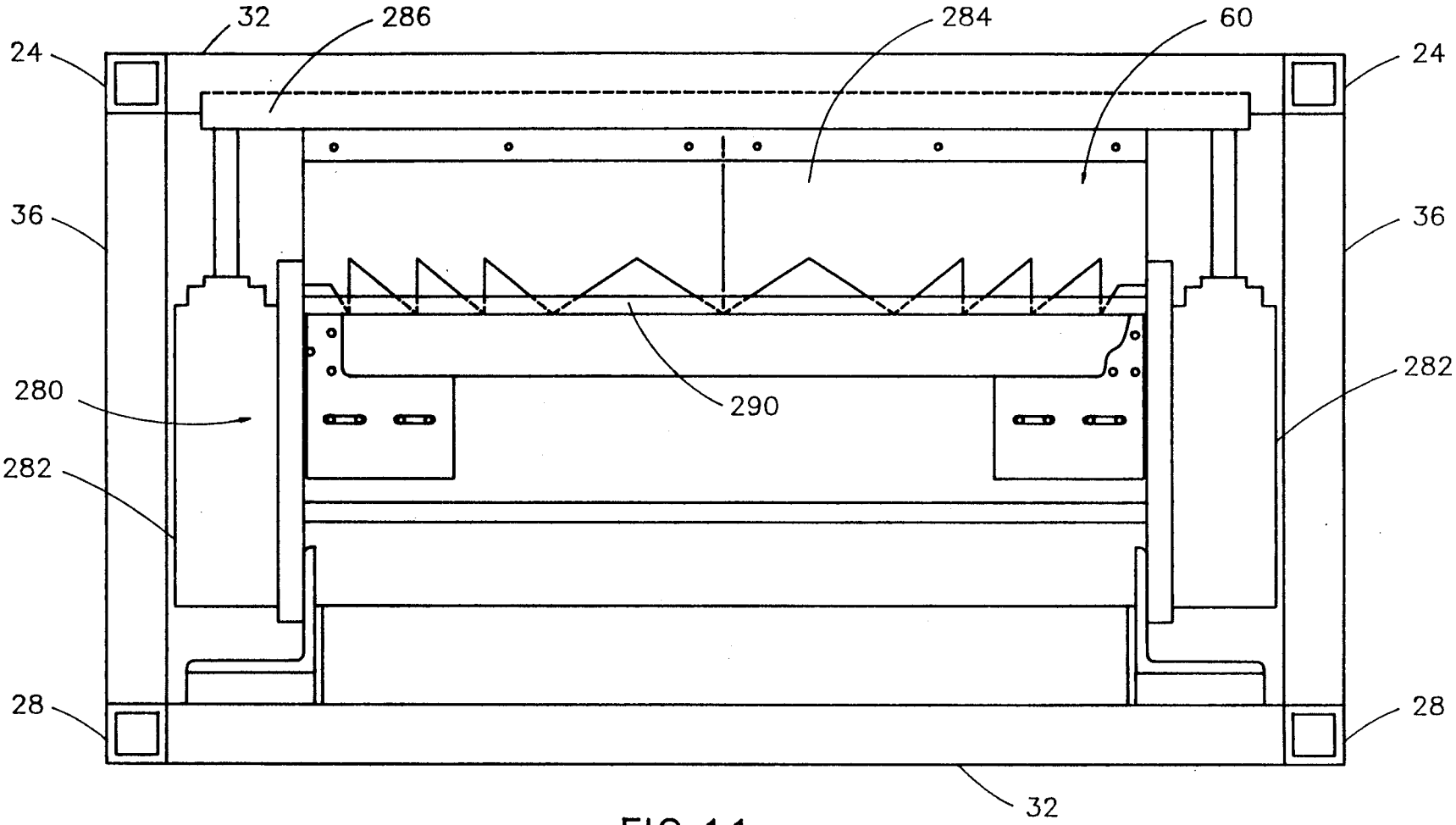
FIG. 11 is a front view of the cutting assembly.

A cutting assembly 280 may be positioned near the exit end 60 of the frame 20 as generally illustrated in FIG. 11. The cutting assembly 280 generally includes a blade 284, appropriately attached to a blade support 286. The blade 284 is driven downwardly by hydraulic cylinders 282 to cut the sheet metal after being appropriately formed by the forming assembly 64, as is known in the art. The cutting action is assisted by the passing of the blade 284 through a shearing plate 290. Since the sheet metal has been formed into the desired configuration when this cutting action takes place, the blade 284 and the shearing plate 290 may have portions which approximate the configuration of the panel so as to reduce the affect thereof o the shaped edges of the panels.

For purposes of controlling operation of the present invention, a detachable control 288 is also provided as shown in FIG. 1. The control 288 may control the motor 184, and thus the rotation of the upper and lower drive rollers 128, 132, and may also control the cutting assembly 280. The control 288 is detachable to facilitate safe operation of the former 16 when used in remote locations.

Another desirable feature of the present invention is its portability. For instance, a trailer (not shown) may be provided for transporting the former 16 to remote sites Moreover, a lifting mechanism (not shown) may be used to engage the trailer and/or the former 16.

Although the present invention has been with respect to specific embodiments thereof, various changes and modifications may be suggested to one skilled in the art, and it is intended that the present invention encompass such changes and modifications as follows in the scope of the appended claims.

What is claimed is:

1. An apparatus for shaping a length of sheet metal having first and second longitudinal edges, comprising:

a frame structure having a central, longitudinal axis;

first and second longitudinal support means interconnected with and laterally movable relative to said frame structure, wherein said first and second longitudinal support means are positioned on opposite sides of said central, longitudinal axis and are substantially equidistant from and parallel to said central, longitudinal axis;

a plurality of first working means for progressively working a first portion of the sheet metal substantially adjacent to the first longitudinal edge, said plurality of first working means being longitudinally spaced along and connected to said first longitudinal support means;

a plurality of second working means for progressively working a second portion of the sheet metal substantially adjacent to the second longitudinal edge, said plurality of second working means being longitudinally spaced along and connected to said second longitudinal support means;

advancing means, positioned between said first and second longitudinal support means about said central, longitudinal axis and interconnected with and supported by said frame structure, for advancing the sheet metal by said plurality of first and second working means to progressively work the first and second portions, respectively, of the sheet metal, said advancing means comprising a plurality of longitudinally spaced drive roller assemblies, wherein each said drive roller assembly comprises at leastone upper drive roller and at least one lower drive roller for engaging the sheet metal therebetween;

at least two means for adjusting a lateral distance between said first and second longitudinal support means to thereby adjust a lateral distance between said first working means and said second working means, wherein said first and second longitudinal support means remain substantially equidistant from and parallel to said central, longitudinal axis during and after lateral movement of said first and second longitudinal support means by said means for adjusting, and wherein each said means for adjusting is interconnected with said first and second longitudinal support means, said at least two means for adjusting being longitudinally spaced; and means for supporting said first and second longitudinal support means from said frame structure at least at two longitudinally spaced locations, said means for supporting accommodating lateral movement of said first and second longitudinal support means relative to said frame strcuture by said means for adjusting and being separate from said means for adjusting.

2. An apparatus, as claimed in claim 1, wherein said first and second working means each comprises freely rotatable working roller assemblies.

3. An apparatus, as claimed in claim 2, wherein each said working roller assembly includes vertically spaced and freely rotatable first and second working rollers.

4. An apparatus, as claimed in claim 2, wherein said working roller assemblies of said first working means are positioned along said first longitudinal support means and wherein said working roller assemblies of said second working means are positioned along said second longitudinal support means.

5. An apparatus, as claimed in claim 1, wherein said first and second longitudinal support means are slidable relative to said frame strcuture.

6. An apparatus, as claimed in claim 1, wherein each said means for adjusting comprises screw rod means having a first portion threadably engagable with said first longitudinal support means and a second portion threadably engagable with said second longitudinal support means.

7. An apparatus, as claimed in claim 6, further including driving means for rotating each said screw rod means in a first direction and a second direction, wherein rotation in said first direction forces said first and second longitudinal support means toward said advancing means and rotation in said second direction forces said first and second longitudinal support means away from said advancing means.

8. An apparatus, as claimed in claim 6, wherein said screw rod means are synchronously interconnected by a chain and gear assembly.

9. An apparatus, as claimed in claim 8, wherein a driving means directly rotates one of said screw rod means and said remaining screw rod means are rotated by said chain and gear assembly.

10. An apparatus, as claimed in claim 1, wherein said advancing means is interconnected with motor means.

11. An apparatus, as claimed in claim 1, wherein each said drive roller assembly further includes a pair of laterally displaced upper drive rollers and a pair of laterally displaced lower drive rollers.

12. An apparatus, as claimed in claim 11, wherein each said pair of laterally displaced upper drive rollers are substantially vertically aligned with a corresponding pair of said laterally displaced lower drive rollers.

13. An apparatus, as claimed in claim 1, wherein said at least one upper and lower drive roller of said drive roller assemblies each include an elastomeric cover which engages the sheet metal.

14. An apparatus, as claimed in claim 1, wherein said plurality of upper drive rollers are interconnected by a first chain and gear assembly and wherein said plurality of lower drive rollers are interconnected by a second chain and gear assembly.

15. An apparatus, as claimed in claim 14, wherein a motor means rotates one of said at least one upper drive roller of one of said drive roller assemblies and said upper drive rollers of said remaining drive roller assemblies are rotated by said first chain and gear assembly, and wherein said motor means rotates one of said at least one lower drive roller of one of said drive roller assemblies and said lower drive rollers of said remaining drive roller assemblies are rotated by said second chain and gear assembly.

16. An apparatus, as claimed in claim 1, wherein said plurality of drive roller assemblies are rotatably driven by motor means.

17. An apparatus, as claimed in claim 16, wherein said at least one upper and lower drive rollers for each said drive roller assembly are substantially vertically aligned.

18. An apparatus, as claimed in claim 16, wherein each of said drive roller assemblies includes a pair of upper, laterally displaced, drive rollers which are substantially vertically aligned with a pair of lower, laterally displaced, drive rollers.

19. An apparatus as claimed in claim 16, wherein a portion of said drive roller assemblies comprises an elastomeric material for engaging the sheet metal.

20. An apparatus, as claimed in claim 16, wherein a first portion of each said drive roller assembly is interconnected by a first chain and gear assembly and wherein a second portion of each said drive roller assembly is interconnected by a second chain and gear assembly.

21. An apparatus, as claimed in claim 1, further including cutting means positioned on said frame structure for cutting a predetermined length of the sheet metal.

22. An apparatus, as claimed in claim 1, further including a detachable control means for controlling the apparatus.

23. An apparatus for shaping sheet metal having first and second longitudinal edges, comprising:

a frame structure having a central, longitudinal axis;

first and second longitudinal support means slidably interconnected with and laterally movable relative to said frame structure, wherein said first and second longitudinal support means are laterally spaced, positioned on opposite sides of said central, longitudinal axis, and are substantially equidistant from and parallel to said central, longitudinal axis;

a plurality of working means positioned along each of said first and second longitudinal support means for progressively working portions of the sheet metal substantially adjacent to the first and second longitudinal edges, respectively;

at least two screw rod means, each having a first portion threadably engagable with said first longitudinal support means and a second portion threadably engagable with said second longitudinal support means, wherein said at least two screw rod means are longitudinally spaced;

drive means for rotating said at least two screw rod means in a first and second direction, wherein rotation in said first direction forces said first and second longitudinal support means toward each other and relative to said frame structure along said at least two screw rod means to thereby reduce a distance between said working means positioned along said first longitudinal support means and said working means positioned along said second longitudinal support means, and wherein rotation in said second direction forces said first and second longitudinal support means away from each other relative to said frame structure along said at least two screw rod means to thereby increase a distance between said workign means positioned along said first longitudinal support means and said working means positioned along said second longitudinal support means, whereby said first and second longitudinal support means remain substantially equidistant from and parallel to said central, longitudinal axis of said frame structure during and after lateral movement of said first and second longitudinal support means bys aid at least two screw rod means and said drive means;

advancing means, positioned substantially about said central, longitudinal axis, for moving the sheet metal by said plurality of working means to progressively work the portions of the sheet metal, said advancing means comprising a plurality of longitudinally spaced advancing roller assemblies, wherein each said advancing roller assembly comprises at least one upper advancing roller and at least one lower advancing roller for engaging the sheet metal therebetween; and a plurality of slidign rod means separate from said at least two screw rod means, wherein each said sliding rod means extends laterally across and is connected to said frame structure, wherein said plurality of sliding rod means are longitudinally spaced along said frame structure, wherein said first and second longitudinal support means are slidably interconnected with and supported by said plurality of sliding rod means, and wherein said plurality of sliding rod means accommodate lateral movement of said first and second longitudinal support means relative to said frame structure by rotation of said at least two screw rod means by said drive means.

24. An apparatus, as claimed in claim 23, wherein said working means includes a plurality of spaced working roller assemblies positioned along said first and second longitudinal support means.

25. An apparatus, as claimed in claim 24, wherein each said working roller assembly includes an upper working roller and a substantially vertically aligned lower working roller.

26. An apparatus, as claimed in claim 24, wherein said working roller assemblies are freely rotatable.

27. An apparatus, as claimed in claim 23, further includign connecting means interconnected said at least two screw rod means to allow synchronous rotation of said at least two screw rod means in the same direction.

28. An apparatus, as claimed in claim 27, wherein said connecting means is a first chain and gear assembly.

29. An apparatus, as claimed in claim 27, wherein said drive means directly rotates only one of said screw rod means.

30. An apparatus, as claimed in claim 23, wherein said advancing means includes a plurality of alterally dispalced pairs of upper advancing rollers spaced along and interconnected to said frame structure and a plurality of laterally displaced pairs of lower advancing rollers spaced along and interconnected to said frame structure.

31. An apparatus, as claimed in claim 23, wherein a portion of said advancing means which engages the sheet metal comprises an elastomeric material.

32. An apparatus, as claimed in claim 23, further including cutting means connected to said frame structure to cut the sheet metal stock at a predetermined length.

33. An apparatus, as claimed in claim 23, further including control means detachably connected to said frame structure for controlling the apparatus.

34. An apparatus for forming panel sections from sheet metal stock having first and second longitudinal edges, comprising:

a frame structure having a central, longitudinal axis;

first and second longitudinal support means interconnected with and laterally movable relative to said frame structure, wherein said first and second longitudinal support means are laterally separated, positioned on opposite sides of said central, longitudinal axis, and are substantially equidistant from and parallel to said central, longitudinal axis;

a plurality of freely rotatable working roller assemblies spaced along and connected to said first and second longitudinal support means for progressively working portions of the sheet metal substantially adjacent to the first and second longitudinal edges, respectively;

at least two screw rod means, each having a first portion threadably engagable with said first longitudinal support means and a second portion threadably engagable with said second longitudinal support means, wherein said at least two screw rod means are longitudinally spaced;

drive means for rotating said at least two screw rod means in a first and second direction, wherein rotation in said first direction forces said first and second longitudinal support means toward each other and relative to said frame structure along said at least two screw rod means to thereby reduce a distance between said working roller assemblies positioned along said first longitudinal support means and said working roller assemblies positioned along said second longitudinal support means, and wherein rotation in said second direction forces said first and second longitudinal support means away from each other along said at least two screw rod means to thereby increase a distance between said working roller assemblies positioned along said first longitudinal support means and said working roller assemblies positioned along said second longitudianl support means, whereby said first and second longitudinal support means remain substantially equidistant from and parallel to said central, longitudinal axis of said frame structure during and after lateral movement of said first and second longitudinal support means by said at least two screw rod means and said drive means;

a power source associated with said frame structure;

a plurality of driving roller assemblies, connected to said power source and said frame structure, and positioned about said central, longitudinal axis of said frame structure, for advancing the sheet metal stock through said working roller assemblies, said driving roller assemblies being longitudinally spaced and each said driving roller assembly comprising at least one upper driving roller and at least one lower driving roller for engaging the sheet metal stock therebetween;

means for supporting said first and second longitudinal support means from said frame structure at least at two longitudinally spaced locations, said means for supporting accommodating laterla movement of said first and second longitudinal support means relative to said frame structure by said at least two screw rod means and said drive means and being separate from said at least two screw rod means; and cutting means, connected to said frame structure, for cutting a predetermined length of the sheet metal stock.

* * * * *